US009540153B2

(12) United States Patent
Zoppas

(10) Patent No.: US 9,540,153 B2
(45) Date of Patent: Jan. 10, 2017

(54) CAP FOR CONTAINERS OF CARBONATED PRODUCTS

(71) Applicant: Acqua Minerale San Benedetto S.P.A., Scorze (IT)

(72) Inventor: Enrico Zoppas, Conegliano (IT)

(73) Assignee: Acqua Minerale San Benedetto S.P.A., Scorze (IT)

( * ) Notice: Subject to any disclaimer, the term of this patent is extended or adjusted under 35 U.S.C. 154(b) by 12 days.

(21) Appl. No.: 14/646,332

(22) PCT Filed: Nov. 21, 2013

(86) PCT No.: PCT/IB2013/060302
§ 371 (c)(1),
(2) Date: May 20, 2015

(87) PCT Pub. No.: WO2014/080357
PCT Pub. Date: May 30, 2014

(65) Prior Publication Data

US 2015/0274385 A1 Oct. 1, 2015

(30) Foreign Application Priority Data

Nov. 21, 2012 (IT) ..... RM2012A0586

(51) Int. Cl.
*B65D 47/24* (2006.01)
*B65D 41/04* (2006.01)
*B65D 47/32* (2006.01)

(52) U.S. Cl.
CPC ..... *B65D 47/242* (2013.01); *B65D 41/0492* (2013.01); *B65D 47/248* (2013.01); *B65D 47/32* (2013.01)

(58) Field of Classification Search
CPC . B65D 47/242; B65D 41/0492; B65D 47/248; B65D 47/32
(Continued)

(56) References Cited

U.S. PATENT DOCUMENTS 3,221,952 A 12/1965 De See
4,179,051 A 12/1979 Thomas
(Continued)

FOREIGN PATENT DOCUMENTS

DE 102011001651 2/2012
WO WO2007038991 4/2007

*Primary Examiner* — James N Smalley
(74) *Attorney, Agent, or Firm* — Stetina Brunda Garred & Brucker

(57) ABSTRACT

The invention relates to a cap (100) for containers for carbonated and non carbonated beverages, of the type used by sportsmen. The plastic cap consists of a supporting element (1) which is screwed on the bottleneck; a pivotal element (2) which pivots by an angle of approximately 120° with respect to the supporting element (1), acting as opening and closing valve for dispensing the beverage; and optionally, a protective cap (3). The pivotal element (2) closes the container in fluid-tight manner. Unscrewing the cap (3) in a certain direction causes the simultaneous pivoting and translation motion of the pivotal element (2), thereby putting the container in communication with the external environment. A kinematic coupling is also provided, which allows the activation of the pivotal element (2) as opening and closing valve by pushing and pulling the vertex of the pivotal element in axial direction, for the cases in which the protective cap is not available.

12 Claims, 9 Drawing Sheets

(58) Field of Classification Search
USPC ..... 222/520, 521, 549, 83; 215/313, 387; 220/259.3, 259.4
See application file for complete search history.

(56) References Cited

U.S. PATENT DOCUMENTS

| | | | | |
|---|---|---|---|---|
| 4,261,487 | A * | 4/1981 | Seager | B65D 47/242 215/329 |
| 5,772,076 | A | 6/1998 | Juk et al. | |
| 6,279,779 | B1 * | 8/2001 | Laciacera | B65D 5/748 222/541.2 |
| 2003/0106911 | A1 | 6/2003 | Adams et al. | |
| 2004/0050884 | A1 * | 3/2004 | Boggs | B65D 47/127 222/520 |
| 2009/0173755 | A1 * | 7/2009 | Ogawa | B65D 51/1688 222/501 |
| 2012/0168441 | A1 * | 7/2012 | Lane | B65D 47/242 220/212 |

* cited by examiner

CAP FOR CONTAINERS OF CARBONATED PRODUCTS

CROSS REFERENCE TO RELATED APPLICATIONS

The present application claims priority to PCT International Application No. PCT/IB2013/060302 filed on Nov. 21, 2013, which application claims priority to Italian Patent Application No. RM2012A000586 filed Nov. 21, 2012, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a cap for containers, in particular for beverage bottles, of the Sport Cap type with pressure seal for carbonated products and opened by unscrewing.

BACKGROUND ART

Currently, closing systems with the capability of dispensing are widely used for beverage containers of various types, in particular for water, tea, fruit juices and sports drinks, mainly of the disposable type which are generally disposed of once the container is emptied. Normally, such closing systems comprise a valve device which, once made accessible by the removal of a dedicated protective cover, can be opened manually, for example by applying a certain traction, and then brought to the mouth for dispensing the beverage. This type of closure is especially used by sportsmen, for example by cyclists, but not only, who in this way can quench themselves even while in special positions without danger of spillage of the beverage and also using only one hand, with the aid of a grip by their lips or teeth. Today, a cap is particularly widespread for such bottles for sports use having an opening quite simple to be operated by the user, as shown in FIG. 7, which consists of a valve with a cylindrical outer surface, slidably inserted around a guiding and supporting element, which is forced open by axially sliding it with the hands or the teeth in a direction distal to the bottle body. Closing occurs by axially pushing, again with the hands or the teeth, the valve towards the bottle body. Since the closing valve is normally placed in contact with the user's mouth, a cover is provided, which is disposable or insertable again for the protection of the valve from external contaminants. This type of cap also has drawbacks of hygienic nature. The valve is operated both in closing and opening by the mouth and/or the hands, thereby excluding the use of the same container by other users who do not accept a mouth contact with caps already placed in the mouth or touched with the hands by other people. Moreover, one of the problems associated with such a type of cap is related to the practical almost impossibility to use it on bottles containing carbonated beverages which, at the time of opening, if no adequate precautions are taken, can project either gas or the beverage itself with force, possibly in the user's mouth or on his face. Last but not least, a problem with this type of cap is the weight of the complete cap which is large enough due to the fact that the stiffness of the opening valve must be ensured by a suitable thickness of plastic material, the valve being normally grasped with the teeth, which may deform it, preventing proper closing back.

The need of providing a cap of the sports type which allows the above drawbacks to be overcome is therefore felt.

SUMMARY OF THE INVENTION

The primary object of the present invention is to provide a cap for a container of beverages which has a pressure seal, which is effectively usable on containers of carbonated beverages.

A further object of the invention is to provide a cap which further has a device which avoids a sudden and undesired splash of the carbonated beverage in the direction of the user.

Another object of the invention is a cap which is simple to be implemented, easy and quick to open and close, in which the passage that allows the dispensing of the beverage directly in the mouth can be opened or closed without necessarily having a direct contact with the hands or the mouth so as to offer greater hygiene.

The present invention, therefore, aims to achieve the above objects by providing a cap for closing and opening a container of liquids, in particular beverages, defining a longitudinal axis, comprising:

a supporting element, adapted to be fixed to the container, having a first base portion, coaxial to the longitudinal axis, with a fixing device adapted to engage an opening of the container;

a first intermediate portion, coaxial to the longitudinal axis, on the inner part of which there is a plurality of first grooves inclined by a first angle with respect to a base plane orthogonal to the longitudinal axis;

a first vertex portion, coaxial to the longitudinal axis;

a first annular sealing surface, coaxial to the longitudinal axis, arranged at the junction between the first intermediate portion and the first vertex portion;

a pivotal element, inserted in the supporting element and configured to pivot by a predetermined arc of a circle smaller than 180°, having a second base portion, coaxial to the longitudinal axis, on the outer wall of which first passages for the passage of liquid and a plurality of guiding teeth inclined by the first angle are formed, which form a first helical kinematic pair with the plurality of first grooves;

a second intermediate portion, coaxial to the longitudinal axis, on the outer wall of which second passages for the passage of liquid are formed;

a second vertex portion, coaxial to the longitudinal axis;

a second annular sealing surface, of shape complementary to the first annular sealing surface, arranged at the joint between the second base portion and the second intermediate portion, configured to form contact with said first annular sealing surface so as to open and close the container in fluid-tight manner during the use of the cap.

In an advantageous variant, the supporting element comprises a plurality of second guiding teeth inclined by a second angle with respect to the orthogonal plane of the longitudinal axis on the outer wall of the first intermediate portion. Even more advantageously, the cap may comprise a protective cap with two or more grooves formed on an inner wall and inclined by the second angle and forming a second helical kinematic pair with the plurality of second guiding teeth, and wherein the winding direction of the first helical kinematic pair is opposite to the winding direction of the second helical kinematic pair. The second grooves form the second helical kinematic pair with two or more second guiding teeth of the screw thread type. The grooves may be obtained as cuts in the thickness of the walls or through the insert of teeth protruding out of the wall thickness, or as a middle way between a cut and one or two protruding teeth. In fact, it is sufficient that a helical kinematic pair like that of a screw in a nut is created. The protective cap also comprises a vertex portion in the shape of a cylinder closed at the top with a substantially flat surface perpendicular to the longitudinal axis and comprising a motion driving shaft at the centre of the flat surface, with cross section in the shape of triangle or star with three or more tips, the axis of which coincides with the longitudinal axis of the cap and which serves for engaging a seat, with a section having a shape complementary to that of the shaft, internal to the vertex portion of the pivotal element, so that an angular motion of the protective cap, such as in clockwise direction corresponding to closing, pulls the pivotal element in rotation and, by means of the helical kinematic pair, simultaneously causes a proportional translation movement of the pivotal element in a direction parallel to the longitudinal axis, in the direction of a closing cap leaning against the dedicated surface of the supporting element.

Thanks to these features of the invention, a cap can be implemented, having particular lightness and strength, when it is made of plastic material, which has all the functions required, overcoming the drawbacks of the prior art caps. One of the favourite but non exclusive uses of the cap of the invention being in the field of beverage bottles intended to be trashed after being emptied of the beverage, in such a practical application, advantageously, the supporting element is made of HDPE, while the pivotal element and the protective cap are made of polypropylene. In this case, the cap may be used for closing disposable containers, for example made of PET, but it is also perfectly clear to the person skilled in the art that caps according to the invention, made of other suitable materials, may also be used to close reusable containers, e.g. made of durable materials both of plastic and of different materials, e.g. glass, metal, and reusable, e.g. after appropriate washing.

The dependent claims describe preferred embodiments of the invention.

BRIEF DESCRIPTION OF THE FIGURES

Further features and advantages of the invention will appear more clearly from the detailed description of preferred butiron exclusive embodiments of a cap, shown by way of a non-limiting example with the aid of the accompanying drawing tables, in which.

The same reference numerals in the figures identify the same elements or components.

DETAILED DESCRIPTION OF PREFERRED EMBODIMENTS OF THE INVENTION

Figure 1A:
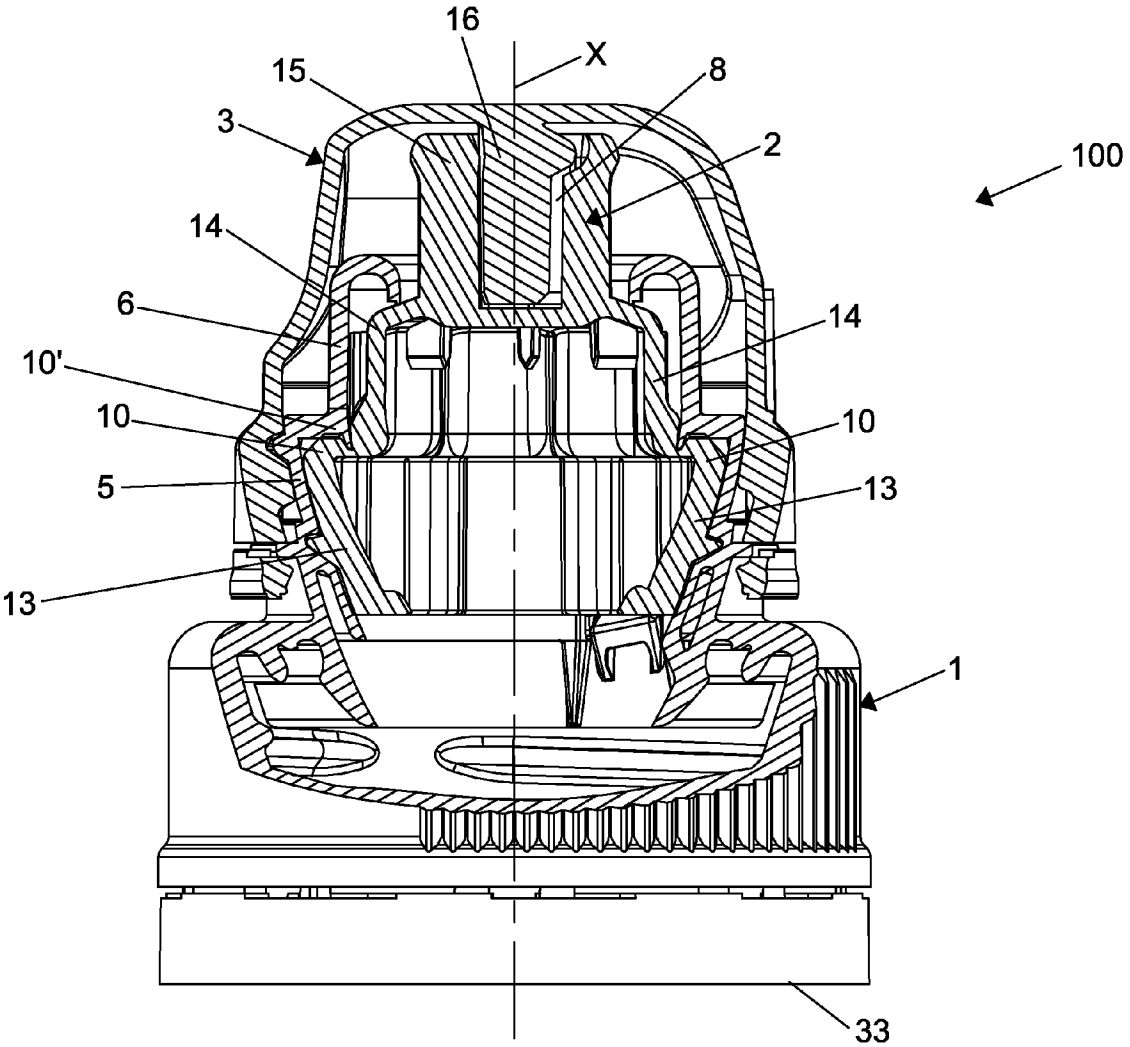
FIGS. 1*a*, 1*b*, 1*c* show partially sectional axonometric views of the assembled cap, object of the invention.
Figure 1B:
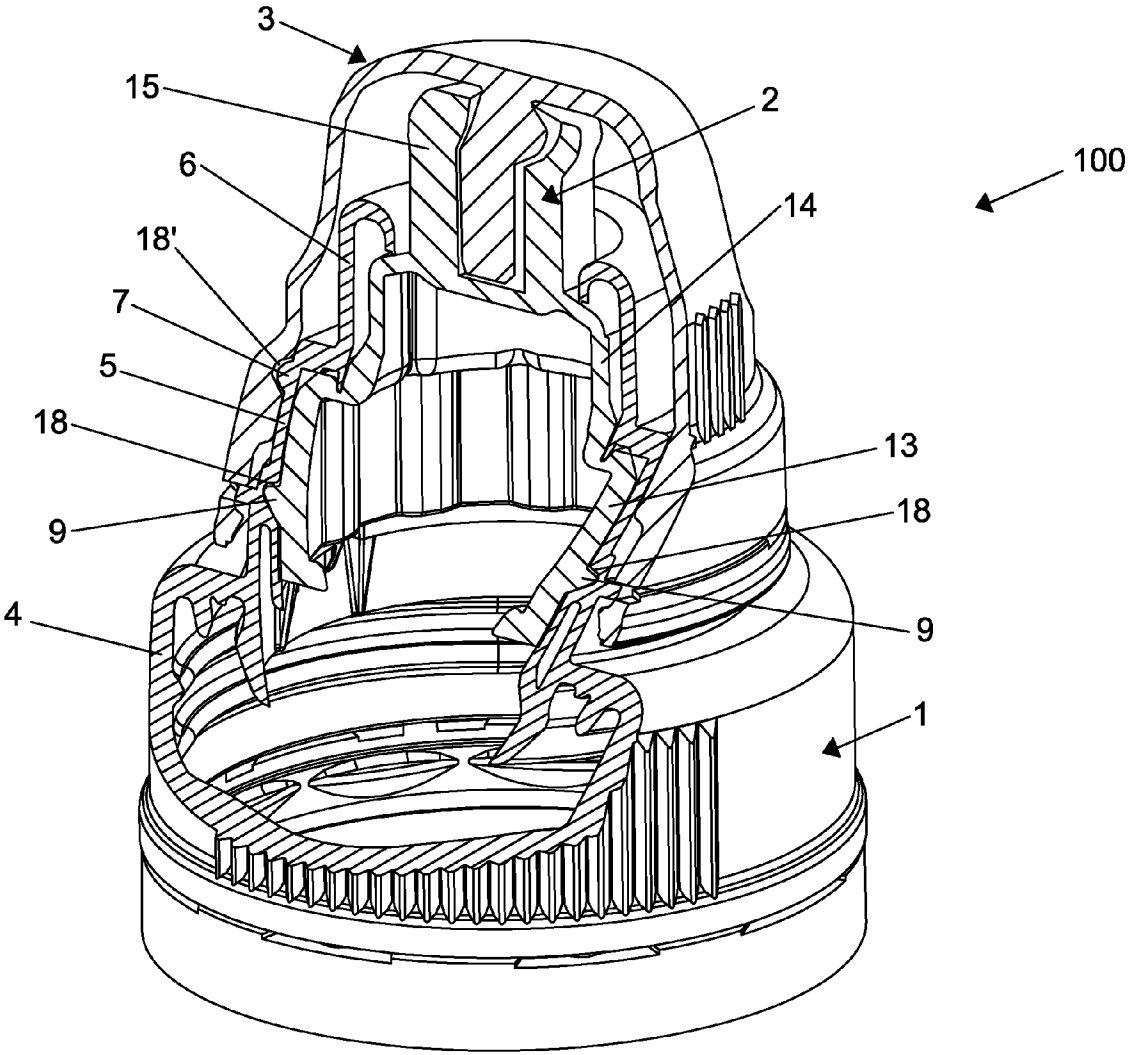
Figure 1C:
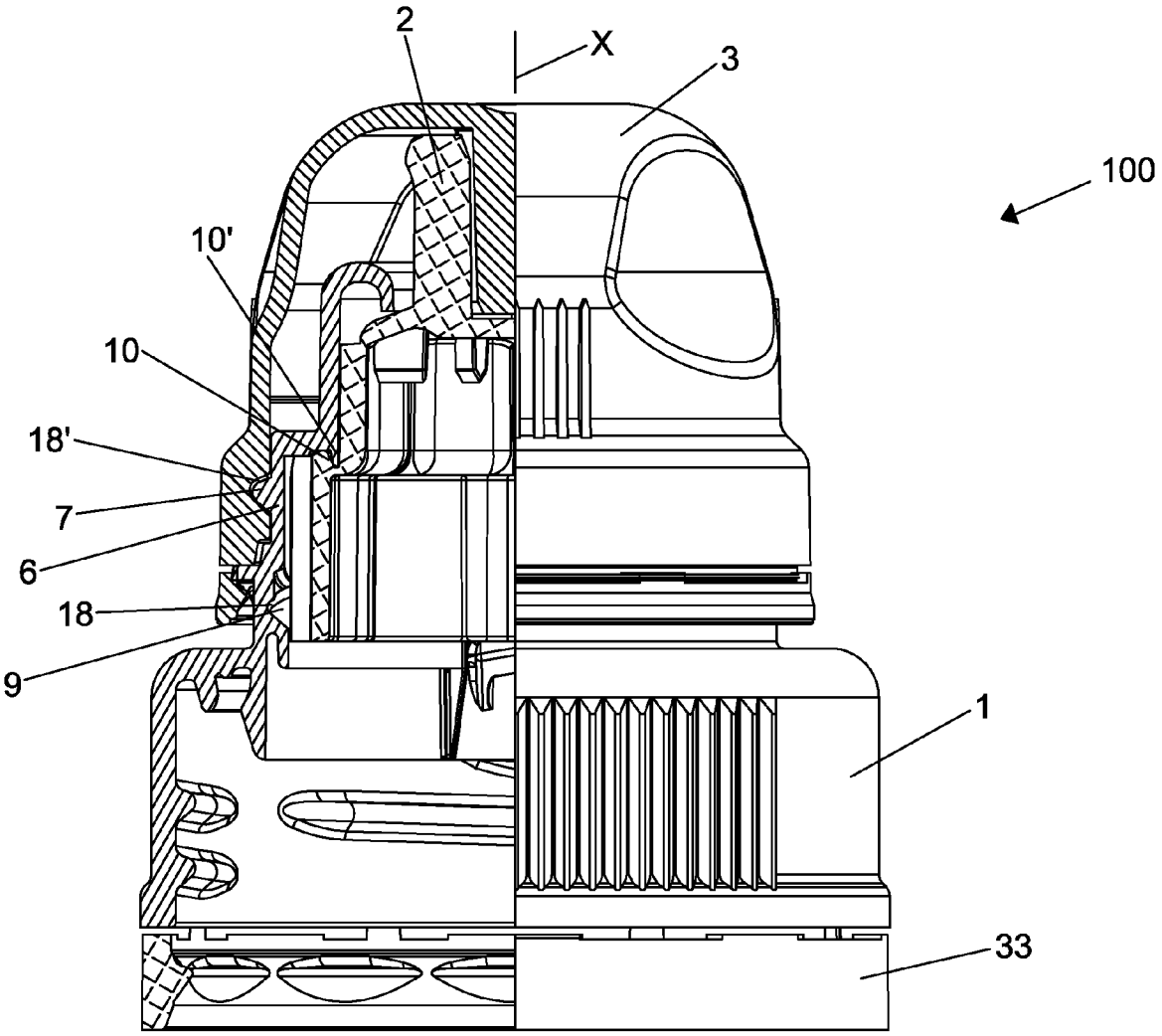
Figure 2:
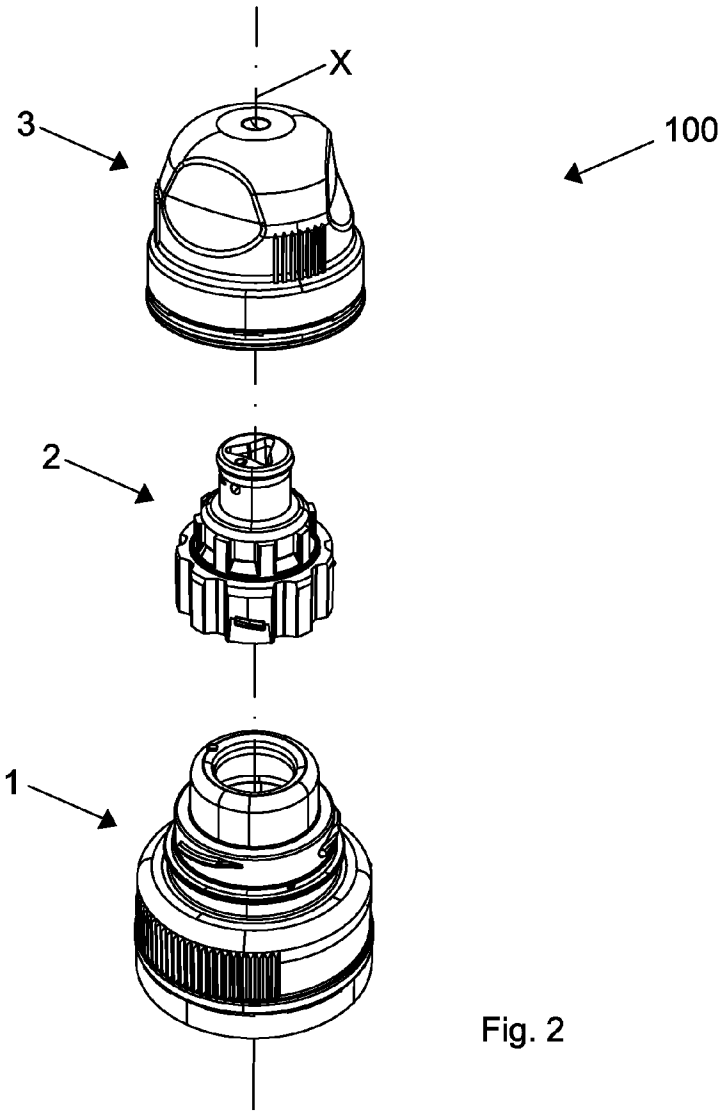
FIG. 2 shows an exploded view of the cap in FIG. 1.
Figure 3:
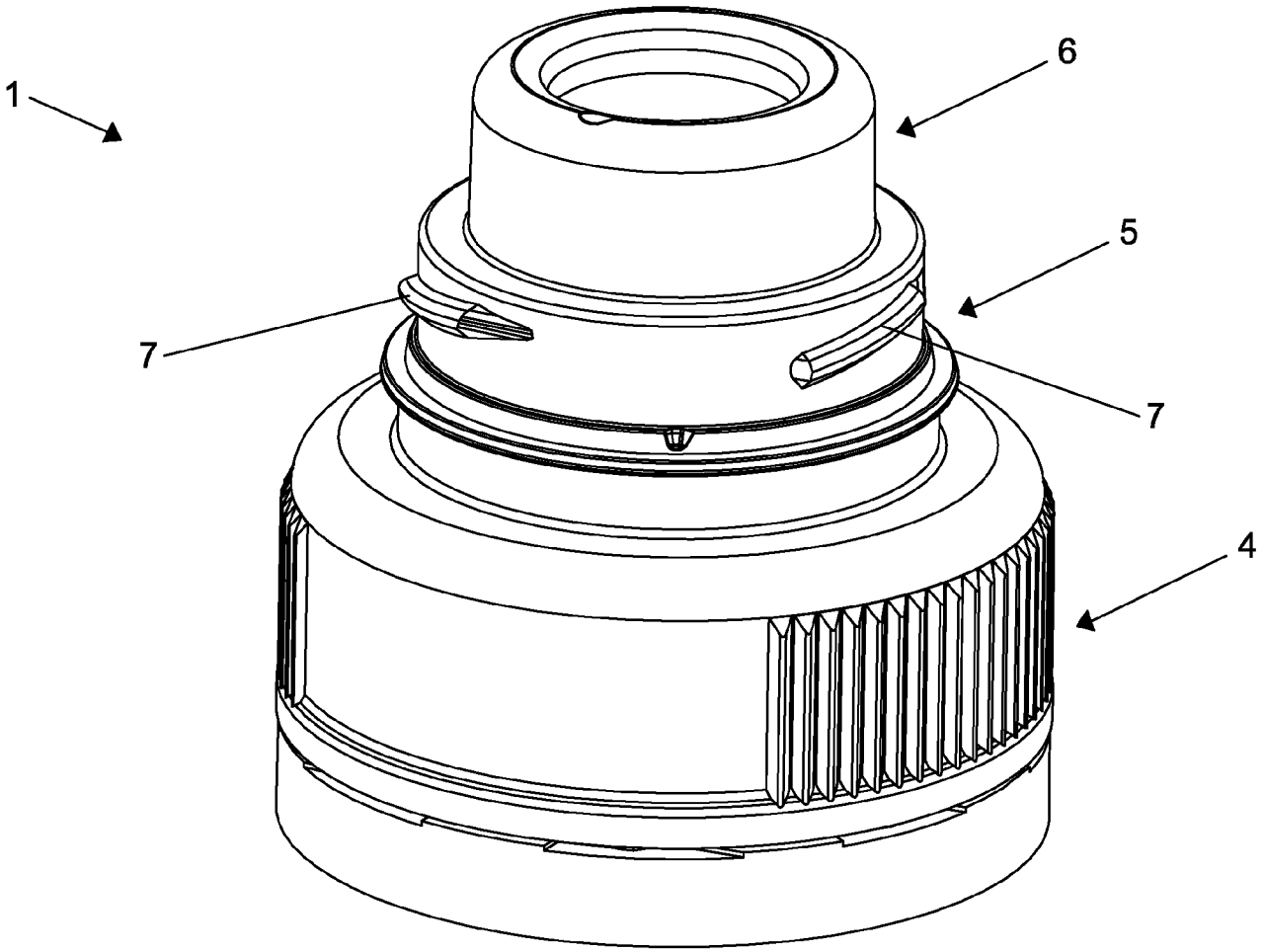
FIG. 3 shows the axonometric view of a first component of the cap in FIG. 2.

With reference to FIGS. 1*a* to 6, an embodiment of a Sport Cap, globally indicated with reference numeral 100, is shown. The cap, object of the present invention, defines a longitudinal axis X, not necessarily a symmetry axis, and comprises a supporting element 1, a pivotal element 2 and a protective cap 3.

The supporting element 1, which represents the part of the cap fixed to the bottle, is in turn substantially formed by three substantially cylindrical portions having decreasing diameter. A base portion 4 having diameter D1 has a thread on the inner wall for screwing the supporting element 1 on the threaded neck of a bottle, not shown in the figures but clearly understandable by the person skilled in the art. Other coupling devices between cap and bottle known in the art are also possible as an alternative to the thread. Reference is made herein to a bottle, as a container, but all the same considerations can be made for containers other than bottles and with necks of a larger or smaller diameter.

The supporting element 1 also comprises an intermediate portion 5, having diameter D2<D1, provided with three guiding teeth 7 on the outer wall and with grooves and tracks on the inner wall. The two base 4 and intermediate portions 5, both substantially cylindrical in shape, can also have the same diameter if the neck size of the bottle the cap is intended for is smaller. The guiding teeth 7 may either be two or in a number equal to or greater than three, and they are inclined according to a helical path, representing very partial stretches of the thread of a screw, it being sufficient that a helical kinematic pair is formed.

The supporting element 1 also comprises a vertex portion 6, substantially cylindrical, having a diameter D3<D2.

The pivotal element 2 acts as a valve for closing and opening the cap which in open position allows the liquid dispensing and in closed position allows the perfect tightness of the bottle even when subjected to high pressure, both internal and external to the bottle.

The pivotal element 2 is inserted within the supporting element 1, in which it is able to angularly oscillate about the longitudinal axis X of cap 100, between two angular end positions of full opening and full closing, respectively, as explained hereinafter in this description.

Figure 4:
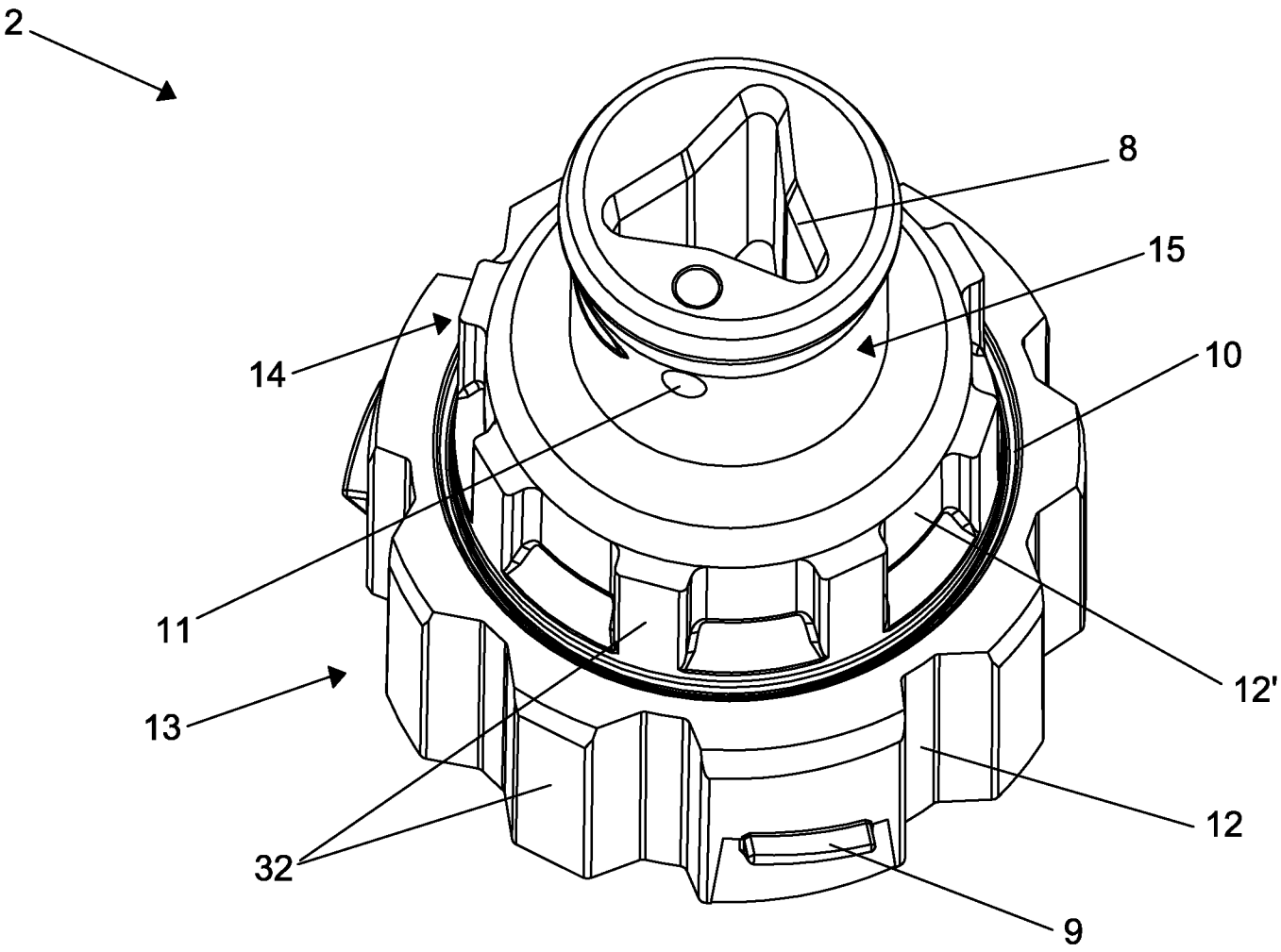
FIG. 4 shows the axonometric view of a second component of the cap in FIG. 2.
Figure 5:
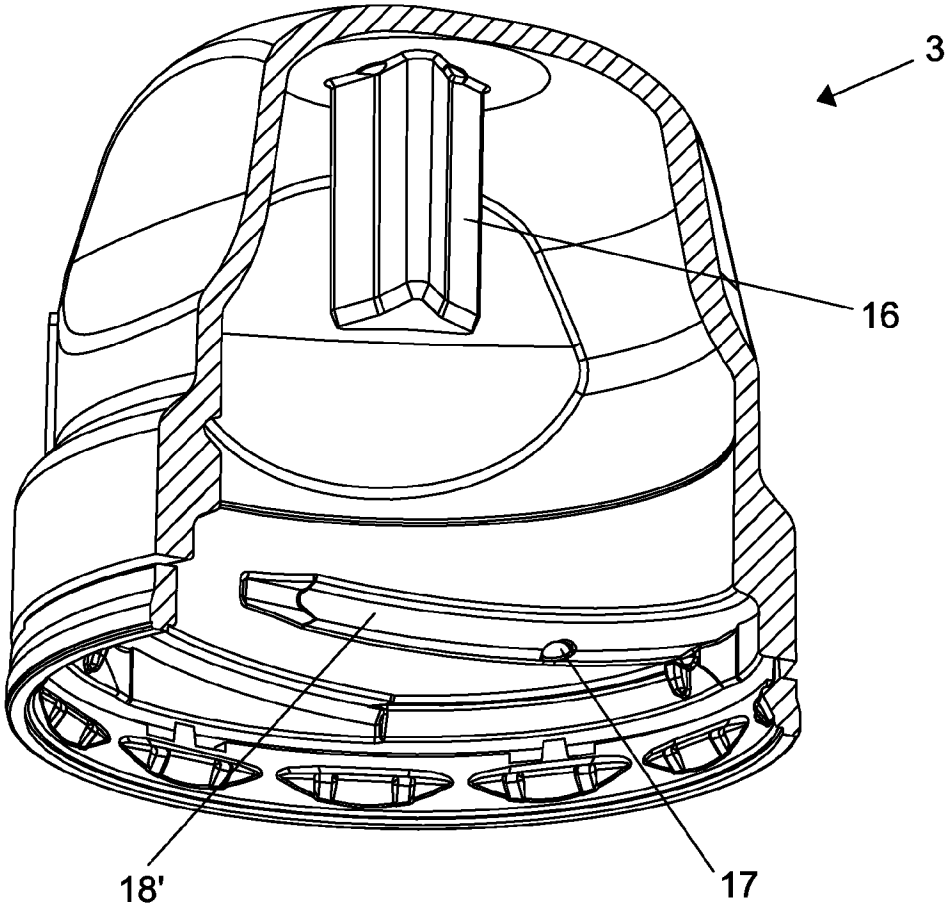
FIG. 5 shows the sectional view according to a vertical plane of a further component of the cap in FIG. 2.

Also the pivotal element 2 is comprised of three portions substantially cylindrical in shape and with decreasing diameter: a base portion 13, an intermediate portion 14 and a vertex portion 15. As can be seen in FIG. 4, the base portion 13 and the intermediate portion 14 of the pivotal element are provided, along the outer wall, with a plurality of longitudinal grooves 12, 12' for allowing the passage of the beverage when the pivotal element 2 is in its open position.

An annular sealing surface 10, such as cylindrical or frusto-conical, is made in the shape of a circular lip on the outer surface between the base portion 13 and the intermediate portion 14 of the pivotal element 2. If appropriate, the cap seal may also be increased by arranging an elastomeric sealing ring along the annular sealing surface 10, or by providing a flexible annular lip made in the injection moulding process of the pivotal element 2.

When cap 100 is in the closed position, the passage of the beverage between the inside and the outside of the bottle is prevented by the high specific pressure contact that is created between the sealing surface 10 and the corresponding annular sealing surface or lip 10' on the inner surface of the supporting element 1 formed along a junction line between the intermediate portion 5 and the vertex portion 6 of the supporting element 1.

The base portion 13 of the pivotal element 2 is provided with three guiding teeth 9, arranged in equidistant position about the perimeter, having a helical or involute shape to facilitate the oscillation motion between the supporting element 1 and the pivotal element 2. The guiding teeth 9 engage the complementary shaped grooves 18 obtained on the inner surface 5' of the intermediate portion 5 of the supporting element 1, such as the threads of a screw inside a nut. The shape of the involute is chosen in such a way as to allow a rotation between the supporting element 1, and the pivotal element 2 accompanied by the simultaneous translation in axial direction of the pivotal element 2 in the direction of his approach towards the inside of the bottle. The guiding teeth may also be in a number of two or more than three.

In this partial rotation and translating motion thereof, the pivotal element 2 causes the detachment of the sealing lip 10' of the supporting element 1 from the annular sealing surface 10 of the pivotal element 2, first allowing the venting of the pressure inside the container when the liquid therein contains gas, thus preventing the splash directly in the user's mouth, and also opening the passage for the product along the longitudinal grooves 12, 12'. The amount of beverage dispensing is adjusted by choosing the angle by which the pivotal element 2 is pivoted about axis X since a given angular displacement of the pivotal element 2 is proportional to the translation movement of the pivotal element 2 with respect to the supporting element 1 as a function of the particular geometry selected for teeth 9. The maximum amount of dispensing flow occurs when the pivotal element 2 reaches the design travel end. The maximum amount of dispensing flow also depends on the size of the passage sections of the longitudinal grooves 12, 12'. The longitudinal surfaces 32, between one groove and the next, also have the function of centring the pivotal element 2 on the supporting element 1. The total or partial opening and closing of cap 100 are produced by the pivoting of the pivotal element 2 about axis X by an appropriate arc of an angle by grabbing the vertex portion 15 with the fingers or teeth and pivoting it with respect to the supporting element 1 which, in use, is screwed onto the bottle and integral therewith.

In a particularly advantageous embodiment of the cap of the invention, there is provided a protective cap 3 which essentially, although not exclusively, has hygienic protection functions to prevent foreign matters, such as dust and other, from being deposited on the pivotal element 2, which is generally grabbed with the mouth by the user. In this variant, the cap of the invention will be marketed almost exclusively with the protective cap, preferably also provided with a sealing ring 33, to make evident any opening of the bottle that occurred earlier. Three guiding teeth 7 are provided, made on the outer surface of the supporting element 1, which engage in the complementary grooves 18' obtained on the inner wall of the protective cap 3 which can develop a working angle of about 90° about axis X, but also other larger or smaller working angles are possible. It is clear to the person skilled in the art that grooves 18, 18' may alternatively be made as guides with side in relief with respect to the inner wall of the protective cap 3 or of the pivotal element 2. Also in this case, the guiding teeth 7 may be only two or more than three as required.

The protective cap 3 comprises a driving shaft 16 therein, having a lobed or star-shaped section with three or more tips or lobes. The driving shaft 16 is placed at the centre of the protective cap 3 and in line with axis X and is configured to be seated in a seat 8 obtained on the vertex portion 15 of the pivotal element 2, which has a shape complementary to that of the driving shaft 16. Thanks to the fitting of the driving shaft 16 in seat 8, in angularly turning the protective cap 3, the pivotal element 2 is made to angularly turn at the same time by the same angular displacement.

The winding direction of the helical path of the helical kinematic pair consisting of teeth 7 and grooves 18' (FIGS. 1*b* and 1*c*) is opposite to the winding direction of the helical path of the helical kinematic pair consisting of teeth 9 and grooves 18 (FIGS. 1*b* and 1*c*) obtained on the inner wall of the intermediate portion 5 of the supporting element 1, so that an angular pivoting of the protective cap 3, which drags the pivotal element 2 in rotation by the same angle by means of the motion driving shaft 16, also causes a translation in the axial direction, in the direction of a detachment of the sealing surface 10 from the corresponding annular sealing lip 10' on the inner surface of the supporting element 1, so as to open cap 100, and thereby the bottle too, when the cap is fixed on the neck of the bottle or, more generally, of the container, not shown in the figures.

An angular rotation of the protective cap 3 in the direction opposite to that which causes the opening clearly causes a closing of cap 100 due to the approach that the rotation of the pivotal element 2 causes between the annular sealing surface 10 and the corresponding annular sealing lip 10' (FIG. 1*a*, 1*c*) thanks to the action of the helical kinematic pair. The angular rotation of the pivotal element 2 about axis X is caused by grabbing the protective cap 3 with the fingers. In this case, the opening and closing of cap 100 can be operated without the fingers touching the surfaces contacted by the mouth during the dispensing of the beverage. Moreover, during the operation of opening cap 100, if the content of the bottle is a carbonated beverage, any splashes which are sometimes produced at a little opening between the inside of the bottle and the external environment, hit the inside of the protective cap 3 covering the pivotal element 2 until the opening is finished.

The correct insertion position of the protective cap 3 with respect to the supporting element 1 is determined by means of a teat 17 obtained on a groove 18 which acts as travel end.

A drainage hole 11 may be provided on the pivotal element 2 which connects the cavity of seat 8 with the outside, thereby allowing the discharge of the beverage that may settle within seat 8 during the dispensing, occupying the space intended for the driving shaft 16.

Figure 6:
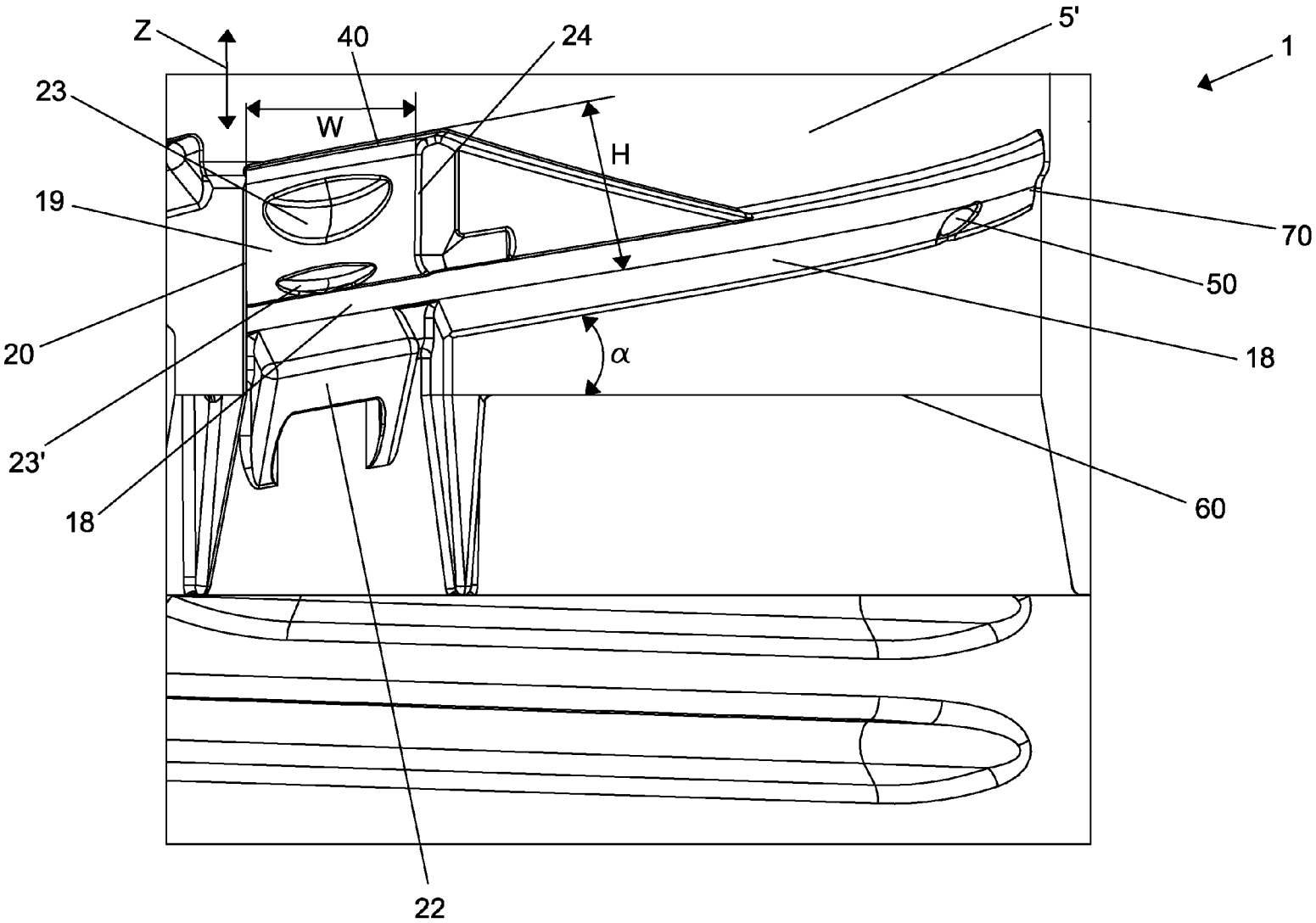
FIG. 6 shows the enlarged view of a detail of the first component of the cap shown in FIG. 3.

FIG. 6 shows in axonometry an area of the inner wall 5' of the intermediate portion 5 of the supporting element 1 for a better understanding of the details. It is clear to the person skilled in the art that what described so far is equally repeated for each of the three guiding teeth 9, not shown, which each have a corresponding perfectly equal area 5'.

Reference numeral 18 indicates a groove which is inclined by an angle (with respect to a horizontal base line 60. Groove 18 serves as a guide for one of the guiding teeth 9 of the pivotal element 2 during the rotation of the latter about axis X. Reference numeral 20 indicates a shoulder which acts as angular travel end in opening of element 2 for the corresponding guiding tooth 9. The angular travel end position in closing of element 2 for the corresponding guiding tooth 9 is established by means of a teat 50 (FIG. 6).

A small shelf 22, preferably partially protruding in groove 18, serves as coupling and retaining to the corresponding guiding tooth 9 which, after having passed over shelf 22 with a snap, for its shape recovery due to the elasticity of the material of which it is made, extends back over shelf 22 and prevents the pivotal element 2 from axially pulling out of the supporting element 1 and dropping into the container after the cap has been mounted. The guiding tooth 9, which on the pivotal element 2 has the same inclination (with respect to a horizontal base line, in its stretched shape fits perfectly inside groove 18, having essentially the same radius as the bottom of groove 18 and, as in the case of a screw thread, when the pivotal element 2 is pivoted with respect to the supporting element 1, an axial displacement of the pivotal element 2 occurs along the direction of arrow Z. In this first opening and closing function of cap 100, which is obtained by the pivoting of the pivotal element 2 about axis X, the guiding tooth 9 moves along the corresponding groove 18 from one end to the other, by an arc of circumference of less than 180°, preferably of about 120°, following groove 18 as a rail. A second groove perfectly equal to groove 18 is engaged by a second guiding tooth not shown, perfectly equal to guiding tooth 9.

A concavity 19, having width W substantially equal to the length of the guiding tooth 9 and height H, along the direction orthogonal to groove 18, is obtained at the portion of groove 18 proximal to shelf 22. Height H has such a value that is substantially equal to the distance from the horizontal base line 60 of end 70 of groove 18 distal from said base line 60, preferably equal to the pitch of a helical passing along groove 18. Concavity 19 has a smaller depth than the depth of groove 18, so that groove 18 is also marked in the area of concavity 19 and also in that area acts as a guide for the guiding tooth 9, although the difference in height between the bottom of concavity 19 and the bottom of groove 18 is less than the difference in height between the bottom of the remaining stretch of groove 18 and surface 5'.

Concavity 19 serves as a rail arranged in axial direction for allowing the sliding of the guiding tooth 9 there along, kept aligned along sides 20 (coinciding with the above shoulder) and 24 of concavity 19. In the angular position of maximum opening of the pivotal element 2, the guiding tooth 9 is at the end of groove 18 which overlaps concavity 19, above shelf 22, where it is held in open cap position. In this opening and closing function through rotation, the guiding tooth 9 only follows the corresponding groove 18 along the helical kinematic pair. Even if the container contains a carbonated liquid which can exert pressure on the pivotal element 2, or in the case where a crush of the plastic container body tends to close the pivotal element 2 against the supporting element 1, inserting the guiding tooth 9 within groove 18 keeps the pivotal element 2 in the open position for cap 100.

A particularly important advantage of the cap of the invention is given by the presence of concavity 19, which allows adding to the opening and closing mode of the cap by means of an angular rotation of the pivotal element 2, an opening and closing mode of cap 100 by means of an axial sliding motion of the pivotal element 2 with respect to the supporting element 1. In addition to the above-described mode of opening the cap by the counter-clockwise rotation, and closing by the clockwise rotation of the pivotal element 2, there is also the opening and closing function of cap 100 by means of a P&P (Push & Pull) mode, where Pull closes the cap and Push opens the cap, i.e. in a direction opposite to the standard P&P mechanism, generally used in "Sport Caps" of the type shown in FIG. 7.

This function is activated when the guiding tooth 9 is aligned with concavity 19, above shelf 22, and a traction of the pivotal element 2 in the direction of arrow Z upwards, in the direction of the illustration in FIG. 6, makes the guiding tooth 9, which is made of flexible plastic of appropriate degree, exit from groove 18. Pulling the pivotal element 2 to make the guiding tooth 9 abut against the upper end 40 of concavity 19, the annular sealing lip 10' presses against the corresponding sealing surface 10.

A projection 23 which rises from the surface of the bottom of concavity 19 engages with the guiding tooth 9 when this is in the closed position for the pivotal element 2, acting as a snap lock, keeping the pivotal element 2 in the closed position and preventing the accidental descent thereof, e.g. due to an impact against the pivotal element 2. In said closed position, the guiding tooth 9 will be arranged between projection 23 and the upper end 40 of concavity 19.

To open the cap in axial translation mode it is sufficient to exert enough pressure on the pivotal element 2 in the direction of the interior of the container, i.e. in the direction of arrow Z downwards, to make the guiding tooth 9 go beyond projection 23.

An alternative embodiment provides for a further projection 23', arranged between groove 18 and projection 23, which defines a position of intermediate opening of the cap when the guiding tooth 9, starting from said closed position, goes beyond projection 23 and remains in the intermediate position between projection 23 and the further projection 23'.

Cap 100 of the invention can therefore function in both opening and closing functions, for example also in case of involuntary loss of the protective cap 3, since the pivoting mechanism as well as the translating opening and closing mechanism are operated by grabbing the vertex portion 15 with the fingers or the teeth and making the pivotal element 2 carry out the movements needed for opening and closing cap 100.

Since cap 100 is suitable for use for carbonated beverages, the internal pressure of the container favours the closing sealing of the mechanism, since a seal in thrust is created between the pivotal element 2 and the supporting element 1, pushing the sealing lip 10' against the relative seat 10, thus the higher the pressure exerted by the liquid from within the container, the greater the seal; of course, all within the limits dictated by the cap structure.

The mechanical stop position of the pivotal element 2, in the opening step of cap 100, is ensured by shoulder 20 while the hermetic seal for the quality assurance of the product is ensured by the pressure exerted between the sealing surface 10 of the pivotal element 2 and the corresponding sealing lip 10' of the supporting element 1.

It is clear that the annular sealing lip 10' may also be made on the pivotal element 2 and its corresponding sealing surface 10 on the supporting element 1.

In addition to the advantages provided by the present invention already mentioned above, it is also to be noted that the cap of the invention is still more cost-effective than those currently on the market since it consists of a smaller number of pieces (two or three) and a lower weight of the resin used. Finally, the use of HDPE for the supporting element 1 and of polypropylene for the pivotal element 2 and for the protective cap 3 is particularly advantageous both for their resistance and for their gas and liquid seal. Based on the foregoing, it is clear that the protective cap 3 has the dual function of protective element for hygienic protection of the cap and of element which facilitates the opening and closing of the cap.

Figure 7:
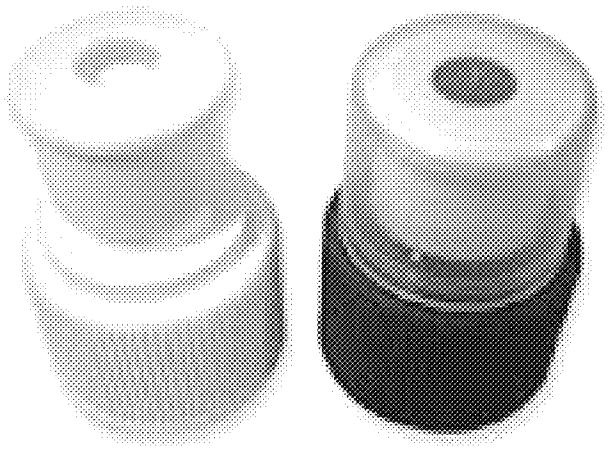
Fig. 7 (Prior Art)
FIG. 7 shows a typical cap of prior art commonly called "sport cap".

A further embodiment of the cap of the invention, alternative to the variants described above, instead only provides for the opening and closing of cap 100 by means of an axial sliding movement of element 2, in this case only a translating element, with respect to the supporting element 1 along said direction Z; i.e. it only provides for opening and closing cap 100 by means of a P&P (Pull & Push) mode, where Pull closes the cap and Push opens the cap, i.e. in a direction opposite to the standard P&P mechanism generally used in "Sport Caps" of the type shown in FIG. 7.

In this embodiment, the guiding teeth 9 are arranged aligned with the respective concavities 19, above shelf 22, and a traction of the translating element 2 in the direction of arrow Z upwards, in the direction of the illustration in FIG. 6, makes the guiding teeth 9, which are made of flexible plastic of appropriate degree, exit from a respective seat or groove 18 thereof, above shelf 22. Pulling the translating element 2 to make the guiding tooth 9 abut against the upper end 40 of concavity 19, the annular sealing lip 10' presses against the corresponding sealing surface 10.

A projection 23 which rises from the surface of the bottom of concavity 19 engages with the guiding tooth 9 when this is in the closed position for the translating element 2, acting as a snap lock, keeping the translating element 2 in the closed position and preventing the accidental descent thereof, e.g. due to an impact against the translating element 2. In said closed position, the guiding tooth 9 will be arranged between projection 23 and the upper end 40 of concavity 19.

To open the cap in axial translation mode it is sufficient to exert enough pressure on the translating element 2 in the direction of the interior of the container, i.e. in the direction of arrow Z downwards, to make the guiding tooth 9 go beyond projection 23.

An alternative variant provides for a further projection 23', arranged between groove 18 and projection 23, which defines a position of intermediate opening of the cap when the guiding tooth 9, starting from said closed position, goes beyond projection 23 and remains in the intermediate position between projection 23 and the further projection 23'.

In this embodiment, therefore, cap 100, defining a longitudinal axis X, comprises:

a supporting element 1, adapted to be fixed to the container, having a first base portion 4, coaxial to the longitudinal axis X, with a fixing device adapted to engage an opening of the container;

a first intermediate portion 5, coaxial to the longitudinal axis X, on the inner part of which there is a plurality of grooves or seats 18 inclined by an angle ((other than zero) with respect to a base plane orthogonal to the longitudinal axis X;

a first vertex portion 6, coaxial to the longitudinal axis X;

a first annular sealing surface 10', coaxial to the longitudinal axis X, arranged at the junction between the first intermediate portion 5 and the first vertex portion 6;

an element 2 axially translating along axis X, inserted in the supporting element 1 and having a second base portion 13, coaxial to the longitudinal axis X, on the outer wall of which first passages 12 are formed for the passage of liquid and a plurality of guiding teeth 9 inserted in said grooves or seats 18, arranged parallel to or inclined by the same angle (with respect to the base plane orthogonal to the longitudinal axis X;

a second intermediate portion 14, coaxial to the longitudinal axis X, on the outer wall of which second passages 12' for the passage of liquid are formed;

a second vertex portion 15 coaxial to the longitudinal axis X;

a second annular sealing surface 10, of shape complementary to that of the first annular sealing surface 10', arranged at the joint between the second base portion 13 and the second intermediate portion 14, configured to form contact with said first annular sealing surface 10' so as to open and close the container in fluid-tight manner during the use of cap 100, by means of an axial downward translation and an axial upward translation of said translating element 2, respectively.

The inner wall 5' of the first intermediate portion 5 has a plurality of concavities 19, each concavity being arranged at each of said grooves 18, in particular arranged above the respective groove 18.

Each concavity 19 constitutes a guide for the respective guiding teeth 9 so as to allow the opening of the container with a pressure in axial direction on the translating element 2, and the closing of the container with a traction in axial direction on the translating element 2. Concavities 19 have a smaller depth than the depth of grooves 18.

The invention claimed is:

1. A cap for closing and opening a container of liquids, in particular beverages, defining a longitudinal axis (X), comprising:

a supporting element, adapted to be fixed to the container, having a first base portion, coaxial to the longitudinal axis (X), with a fixing device adapted to engage an aperture of the container;

a first intermediate portion, coaxial to the longitudinal axis (X), on an inner wall of which there is a plurality of first grooves inclined by a first angle with respect to a base plane orthogonal to the longitudinal axis (X);

a first vertex portion, coaxial to the longitudinal axis (X)

a first annular sealing surface, coaxial to the longitudinal axis (X), arranged at a junction between the first intermediate portion and the first vertex portion;

a pivotal element, inserted in the supporting element and configured to pivot by a predetermined arc of a circle smaller than 180°, having a second base portion, coaxial to the longitudinal axis (X), on an outer wall of which first, passages for a passage of liquid and a plurality of first guiding teeth inclined by the first angle are formed, which form a first helical kinematic pair with the plurality of first grooves;

a second intermediate portion, coaxial to the longitudinal axis (X), on an outer wall of which second passages for the passage of liquid are formed;

a second vertex portion coaxial to the longitudinal axis (X);

a second annular sealing surface, of shape complementary to that of the first annular sealing surface, arranged at a joint between the second base portion and the second intermediate portion, configured to form contact with said first annular sealing surface so as to open and close the container in fluid-tight manner during an use of, the cap.

2. The cap according to claim 1, wherein an angular rotation of the pivotal element about the longitudinal axis (X) causes a translation parallel to the longitudinal axis (X) of the pivotal element by virtue of said first helical kinematic pair so as to carry out said opening and closing, depending on a direction of rotation of the angular rotation.

3. The cap according to claim 2, wherein the inner wall of the first intermediate portion has a plurality of concavities, each concavity being arranged at an end of each of said first grooves proximal to the first base portion of the supporting element.

4. The cap according to claim 3, wherein each concavity constitutes a guide for one of said first guiding teeth so as to allow the opening of the container with a pressure in axial direction on the pivotal element, and the closing of the container with a traction in direction axial on the pivotal element.

5. The cap according to claim 4, wherein the concavities have a depth smaller than a depth of the first grooves and every concavity is crossed by a respective first groove so as to extend said first helical kinematic pair within the concavities.

6. The cap according to claim 1, wherein the supporting element comprises a plurality of second guiding teeth inclined by a second angle with respect to the base plane orthogonal to the longitudinal axis (X) on an outer wall of the first intermediate portion.

7. The cap according to claim 6, comprising a protective cap with two or more second grooves formed on an inner wall and inclined by the second angle and forming a second helical kinematic pair with the plurality of second guiding teeth, and wherein a winding direction of a first helical path of the first helical kinematic pair is opposite to a winding direction of a second helical path of the second helical kinematic pair.

8. The cap according to claim 7, wherein the second guiding teeth develop a 90° working angle on the protective cap and an end of travel position of the protective cap is established by means of a teat.

9. The cap according to claim 8, wherein the protective cap comprises a motion driving shaft coaxial to the longitudinal axis (X) and with a three or more tipped star-shaped cross section, which engages a seat in the second vertex portion having an inner section complementary to said cross section, so that an annular movement of the protective cap rotates the pivotal element and causes a proportional translation movement of the pivotal element in direction parallel to the longitudinal axis (X) at the same time.

10. The cap according to claim 1, wherein the first passages and the second passages are longitudinal grooves.

11. The cap according to claim 1, wherein a through hole, transversal to the longitudinal axis (X), which connects a seat with an outside of the pivotal element, is provided in the second vertex portion.

12. The cap according to claim 7, wherein the supporting element is made of HDPE, the protective cap and the pivotal element are made of polypropylene.

* * * * *